US008038207B2

(12) United States Patent
Flannery

(10) Patent No.: US 8,038,207 B2
(45) Date of Patent: Oct. 18, 2011

(54) ROCKER AND BOOSTER CHILD SEAT

(75) Inventor: Mark A. Flannery, Longboat Key, FL (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 11/505,222

(22) Filed: Aug. 15, 2006

(65) Prior Publication Data

US 2007/0040430 A1 Feb. 22, 2007

Related U.S. Application Data

(60) Provisional application No. 60/709,055, filed on Aug. 16, 2005.

(51) Int. Cl.
*A47D 1/10* (2006.01)

(52) U.S. Cl. ..... 297/174 CS; 297/134; 297/217.6

(58) Field of Classification Search ..... 297/130, 297/134, 174 CS, 118, 363, 364, 271.6
See application file for complete search history.

(56) References Cited

U.S. PATENT DOCUMENTS

| | | | | | |
|---|---|---|---|---|---|
| 2,451,667 | A | * | 10/1948 | Ducey | 297/174 CS |
| D181,700 | S | | 12/1957 | Armitage | D6/339 |
| 2,854,062 | A | * | 9/1958 | Hetchler | 297/270.3 |
| 3,047,333 | A | * | 7/1962 | Stanimir | 297/32 |
| 3,133,760 | A | * | 5/1964 | Robinson | 297/174 CS |
| D248,799 | S | * | 8/1978 | Adams | D6/333 |
| 4,506,928 | A | * | 3/1985 | Marion | 297/174 CS |
| 4,530,539 | A | | 7/1985 | Gaber et al. | 297/174 CS |
| 4,568,120 | A | * | 2/1986 | Hoffman | 297/174 CS |
| 4,629,247 | A | * | 12/1986 | Wu | 297/174 CS |
| 4,818,016 | A | * | 4/1989 | Mariol et al. | 297/174 CS |
| 4,863,216 | A | * | 9/1989 | Prescott | 297/174 CS |
| D315,252 | S | * | 3/1991 | Ho | D6/333 |
| 5,046,651 | A | * | 9/1991 | Dagdagan | 224/155 |
| 5,178,438 | A | * | 1/1993 | Beger | 297/271.6 |
| 5,411,315 | A | | 5/1995 | Greenwood | 297/440.24 |
| 5,480,211 | A | * | 1/1996 | Douglas et al. | 297/174 CS |
| 5,498,054 | A | | 3/1996 | Tomlinson | 297/16.2 |
| 5,626,394 | A | | 5/1997 | Perry | 297/448.2 |
| 5,678,890 | A | | 10/1997 | Tenbroeck | 297/271.6 |
| 6,540,292 | B2 | * | 4/2003 | Darling et al. | 297/130 |
| D480,884 | S | * | 10/2003 | Kane et al. | D6/348 |
| D481,209 | S | * | 10/2003 | Chen | D6/333 |
| 6,679,549 | B2 | * | 1/2004 | Catelli | 297/174 CS |
| 6,736,451 | B1 | * | 5/2004 | Chen | 297/174 CS |
| 6,811,217 | B2 | * | 11/2004 | Kane et al. | 297/270.2 |
| 7,252,333 | B2 | * | 8/2007 | Caldwell | 297/259.2 |
| D578,936 | S | * | 10/2008 | Chen | D12/129 |

(Continued)

*Primary Examiner* — David Dunn
*Assistant Examiner* — Philip Gabler

(57) ABSTRACT

A child seat that can be used as either a rocker or a booster. The child seat has a frame that includes a pair of leg portions having respective curved sections on which the child seat can be rocked back and forth. The same frame includes a pair of arm arrangements that can be engaged to an object such as a table such that the child seat can hang off the table and extend into the air. When engaged to the table, such as to the edge of the table, the seat frame portion of the child seat can be angularly adjusted as to a remaining portion of the frame such that the child seat can recline whether the child seat is in use as a booster or as a rocker. The seat portion of the frame is disposed within the arm arrangement and leg portions of the frame. The frame clamps tightly to the table via the frame resiliently biting into the table when a lock is swung into position.

20 Claims, 13 Drawing Sheets

U.S. PATENT DOCUMENTS

D580,828 S * 11/2008 Chen ..... D12/129
7,455,362 B2 * 11/2008 Hanson et al. ..... 297/363
7,506,922 B2 * 3/2009 Schulte et al. ..... 297/131
7,621,592 B1 * 11/2009 Flannery ..... 297/134
2003/0062757 A1 4/2003 Calvery ..... 297/440.24

* cited by examiner

ROCKER AND BOOSTER CHILD SEAT

This application claims the benefit of U.S. Provisional Patent Application No. 60/709,055 filed Aug. 16, 2005 under 35 U.S.C. §119(e).

FIELD OF THE INVENTION

The present invention relates generally to child seats, more particularly to boosters or booster seats that engage and hang off the edge of tables and rockers or rocker seats in which a child can be rocked gently to sleep, and specifically to a rocker and booster seat combination that can be used as either a booster seat or rocker.

BACKGROUND OF THE INVENTION

A booster or booster seat is a seat for a younger child that boosts or lifts the younger child up to the level of a table such that the younger child is generally at the level of older children, teenagers or adults and such that the child can eat or play at the table. The booster seat may be of a box type that sits on the seat of a chair and that does not engage the table. The booster seat may be of the type that engages the edge of the table and hangs off the edge of the table.

Conventional baby or child rockers are often in a bucket shape. The bucket shape provides for rocking. The bucket shaped rocker may be molded in one piece.

SUMMARY OF THE INVENTION

A feature of the present invention is the unique combination of a child booster and a child rocker.

Another feature of the present invention is the provision in a child seat, of a frame being structured to hang in the air off the side of an object, and of the frame having at least one leg portion having a curved section such that, when removed from the side of the object, the frame may rock via the curved section such as on a safe level surface.

Another feature of the present invention is the provision in a child seat, of a frame being structured to engage the edge of an object and hang off the edge of the object in the air, of the frame having a seat frame portion that is angularly adjustable relative to a remaining portion of the frame whether the child seat is engaged to the edge of the object and hanging off the edge of the object and is in use as a booster or whether the child seat is being rocked on a surface and is in use as a rocker.

Another feature of the present invention is the provision in a child seat, of a frame including a pair of leg portions having respective curved sections on which the child seat can rock, of the frame including a pair of arm arrangements, of the frame including a seat frame portion that is angularly adjustable relative to a remaining portion of the frame, and of the seat frame portion being disposed within the pair of legs portions and within the pair of arm arrangements.

Another feature of the present invention is the provision in a child seat, of a frame that is resiliently locked to a table, thereby providing a firm bite to the table, where the resilient features include 1) the frame itself, including the arm frame portions, the leg frame portions, the lock frame portions, the front brace portion (the leg extension portions), the rear brace portion, and even including the child seat frame portion because such transversely connects in the nature of a brace to two sides of the frame via the hubs, and 2) the resilient grips on the arm frame portions and the leg extension portions.

An advantage of the present invention is that it serves a dual function. The present child seat can be used as either a booster or rocker. A child can eat at the edge of a table with the adults or older children and then, after dinner, when pie and coffee are served and the child is nodding off to sleep, the child seat as a whole can be disengaged from the edge of the table and placed on a safe level surface where the child can be rocked to sleep.

Another advantage of the present invention is that it is relatively inexpensive. First, a caregiver purchases simply one seat, not two. Second, the portions of the frame that provide the structure for the arms, the legs, the seat and the back, are not duplicated even though dual functions (booster seat and rocker seat) are provided. Hence the child seat includes a minimum of parts, reducing manufacturing cost.

Another advantage of the present invention is that it is safe. The portion of the frame where the child sits or rests is tucked within the portion of the frame that provides the structure for the arms and the legs such that the arm and leg portions of the frame shield the child.

Another advantage of the present invention is that certain functions of the child seat are independent of other functions. For example, the child seat can be engaged and locked to an edge of the table. At the same time, the seat frame portion, to which a fabric seat is engaged, may be reclined relative to a remaining portion of the frame. There is no need to disconnect the child seat from the table so as to operate the reclining function of the seat frame portion.

DESCRIPTION

Figure 1:
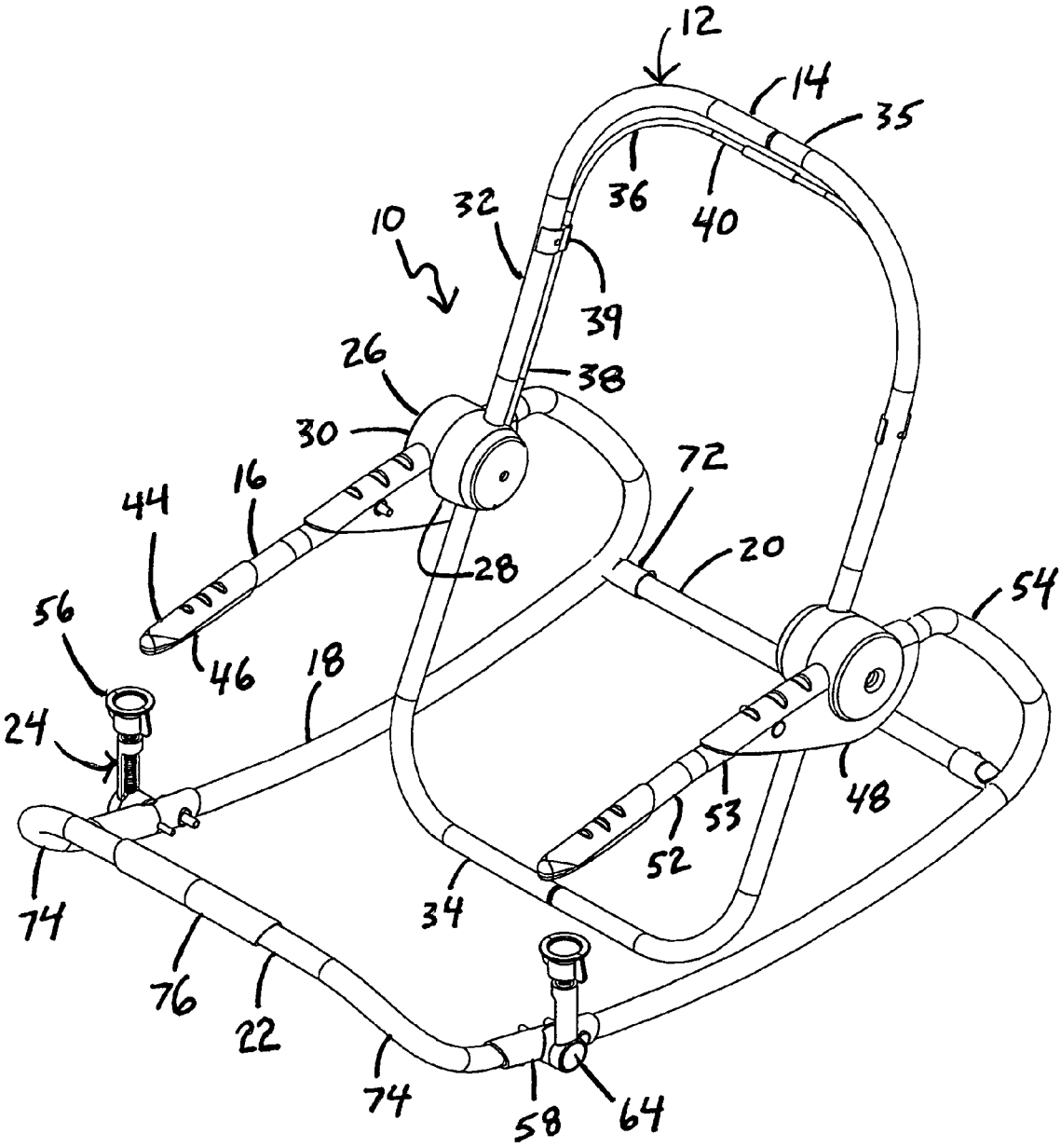
FIG. 1 is a perspective view of the frame of the present child seat.

The present rocker and booster child seat is indicated in general by the reference numeral 10 in FIG. 1. Child seat 10 includes a frame 12. Frame 12 generally includes seat frame tube portion 14, a pair of arm frame tube portions 16 (or upper frame tube portions 16), a pair of leg frame tube portions 18 (or lower frame tube portions 18 or rocking frame tube portions 18), a rear brace tube portion 20, a front brace tube portion 22 (or extension tube portions 22), a pair of locking frame tube portions 24, and a pair of hubs 26 that angularly or swingably engage the seat frame tube portion 14 to the arm frame tube portions 16 and where each of the hubs 26 includes an inner hub portion 28 that rotates relative to and between outer hub portions 30.

Figure 11:
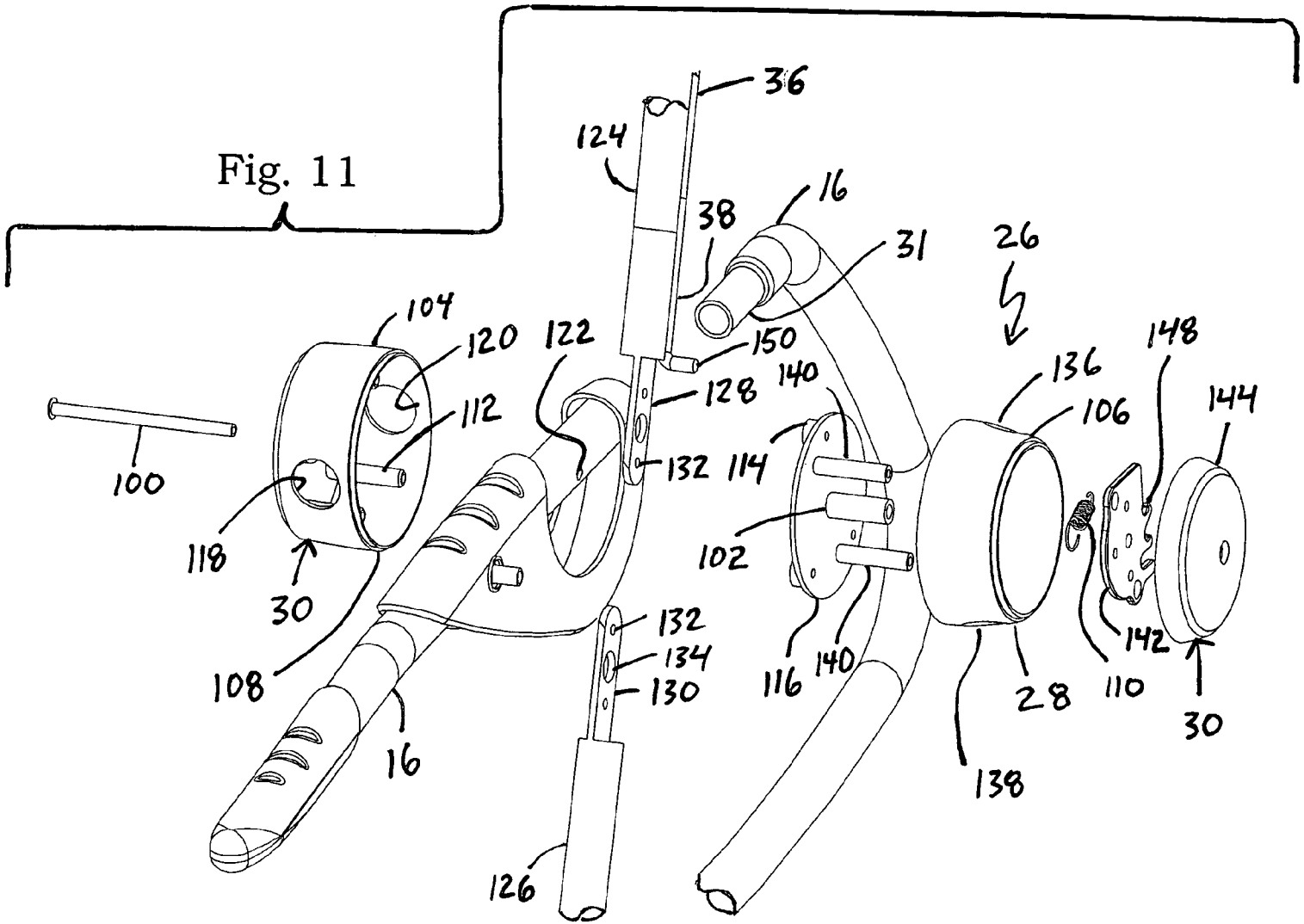
FIG. 11 is an exploded view of the hub of the child seat of FIG. 1.
Figure 12:
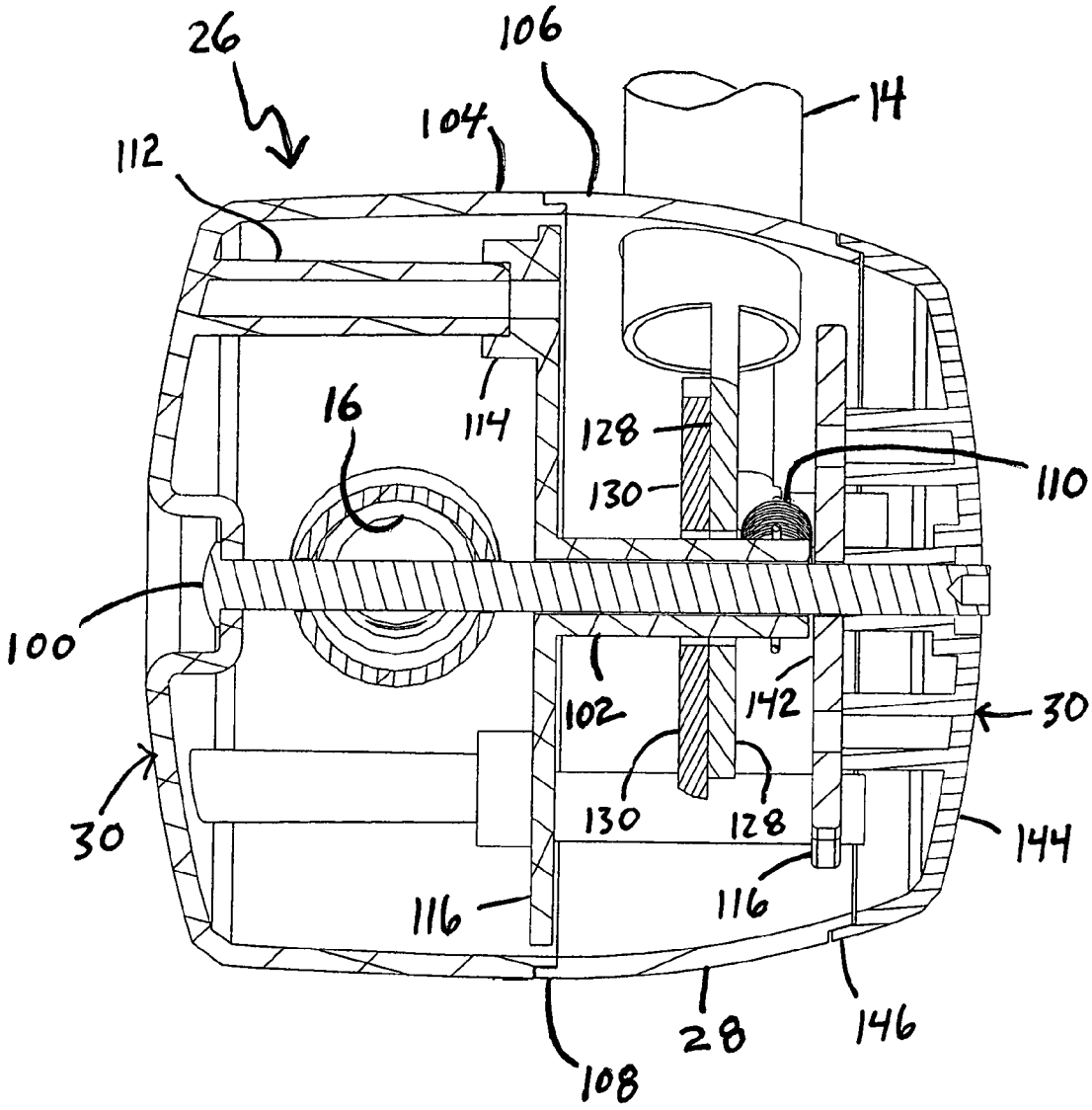
FIG. 12 shows a section view of the hub of FIG. 11.

More specifically, seat frame tube portion 14 is generally rectangular in shape, with corner portions being curved or having a radius. The seat frame tube portion 14 can be broken down into sections, with the sections being again connectable to each other via internal male/female connections. Seat frame tube portion 14 includes elongate side sections 32 that are engaged to inner hub portions 28, such as via internal male/female connections or such as via a through opening that permits an elongate side section 32 to extend wholly through a respective inner hub portion 28. FIGS. 11 and 12 show that an upper elongate side section can be directly tied to a lower elongate side section via ends 128, 130. Seat frame tube portion 14 further includes a lower end section 34 and an upper end section 35, each of which extends between the elongate side sections 32.

Seat frame tube portion 14 further includes a control or lock 36. Lock 36 is a U-shaped rod having two end portions 38, each of which extends into a respective inner hub portion 28. Lock 36 runs generally about one-half of the seat frame portion 14 and is supported in such proximity via clips 39 that permit the rod or lock 36 to slide therein. Each of clips 39 is clipped to an elongate section 32. Lock 36 includes a handle or operating end 40 that runs generally parallel to and is spaced from upper end section 35 of the seat frame portion 14. Via such a spacing, upper end section 35 and handle 40 can be squeezed with one hand to draw the handle 40 towards the upper end section 35 and to draw the end portions 38 out of engagement with inner workings of hub 26 (specifically terminal end 150 is drawn out of engagement with one of the upper, medial or lower notches 148) so as to disengage each of the inner hub portions 28 with their respective outer hub portions 30, so as to permit relative rotation of the hub portions 28, 30, so as to permit seat frame portion 14 to swing angularly relative to a remaining portion of the frame 12, so as to relatively recline seat frame portion 14 or so as to make relatively upright seat frame portion 14 or so as to attain a position therebetween. Upon release of handle 40, lock 36 is automatically drawn back into inner hub portion 28 via an internal bias hub mechanism 110 (shown in FIGS. 11 and 12) so as to lock the hub portions 28, 30 relative to each other and to lock the seat frame portion 14 relative to a remaining portion of the frame 12. Handle 40 is thereupon automatically drawn back to its rest and locked position, which position is spaced from end portion 35.

It should be noted that seat frame portion 14 swings to predefined positions relative to a remaining portion of the frame 12 by operating handle 40. Such positions may be incremental positions by the inclusion of a greater number of notches 148.

To rock a child in child seat 10, the curved sections 62 are employed such that seat frame portion 14 and frame 12 rocks together as a whole. Hub portions 28, 30 are not employed to rock a child. When in use as a booster seat or when in use as a rocker, it is preferred that hub portions 28 and 30 remain locked to each other except for adjustment to or from an upright position, to or from a reclining position, or to or from some other position, of the seat frame portion 14 relative to a remaining portion of the frame 12.

Seat frame portion 14 can engage a seat or bucket or L-shaped structure or some other structure in which a child can be seated. Such a seat may include its own frame or may not have a frame. Such a seat can be formed from a fabric material or plastic material or composite material or metal material or some combination of such materials. Such a seat can engage the upper end section 35, the lower end section 34, the elongate side sections 32, or some combination thereof.

From FIGS. 2, 3, 4 and 5, it can be noted that a length of the lower portion of seat frame portion 14, as defined by lower end section 34, extends beyond leg frame portions 18, on which the child seat 10 can rock on a surface. In other words, when child seat 10 is being used as a rocker, seat frame portion 14 is relatively reclined (as shown in FIG. 9B), such that lower end section 34 does not extend beyond leg frame portions 18. Accordingly, when child seat 10 is being used as a booster, leg frame portions 18 extend into the air, and seat frame portion 14 can be moved to a relatively upright position where lower end section 34 can extend beyond leg frame portions 18 such that a child is in a relatively upright eating position and can eat at a table T (see FIG. 9A) to which the child seat 10 is engaged.

From FIGS. 1, 4, 5, 6 and 7, it can be noted that the seat frame portion 14 is tucked between a remaining portion of the frame 12 to shield a child sitting in a seat engaged to the seat frame portion 14. In other words, the seat frame portion 14 is engaged between the arm frame portions 16 and between the leg frame portions 18.

Figure 2:
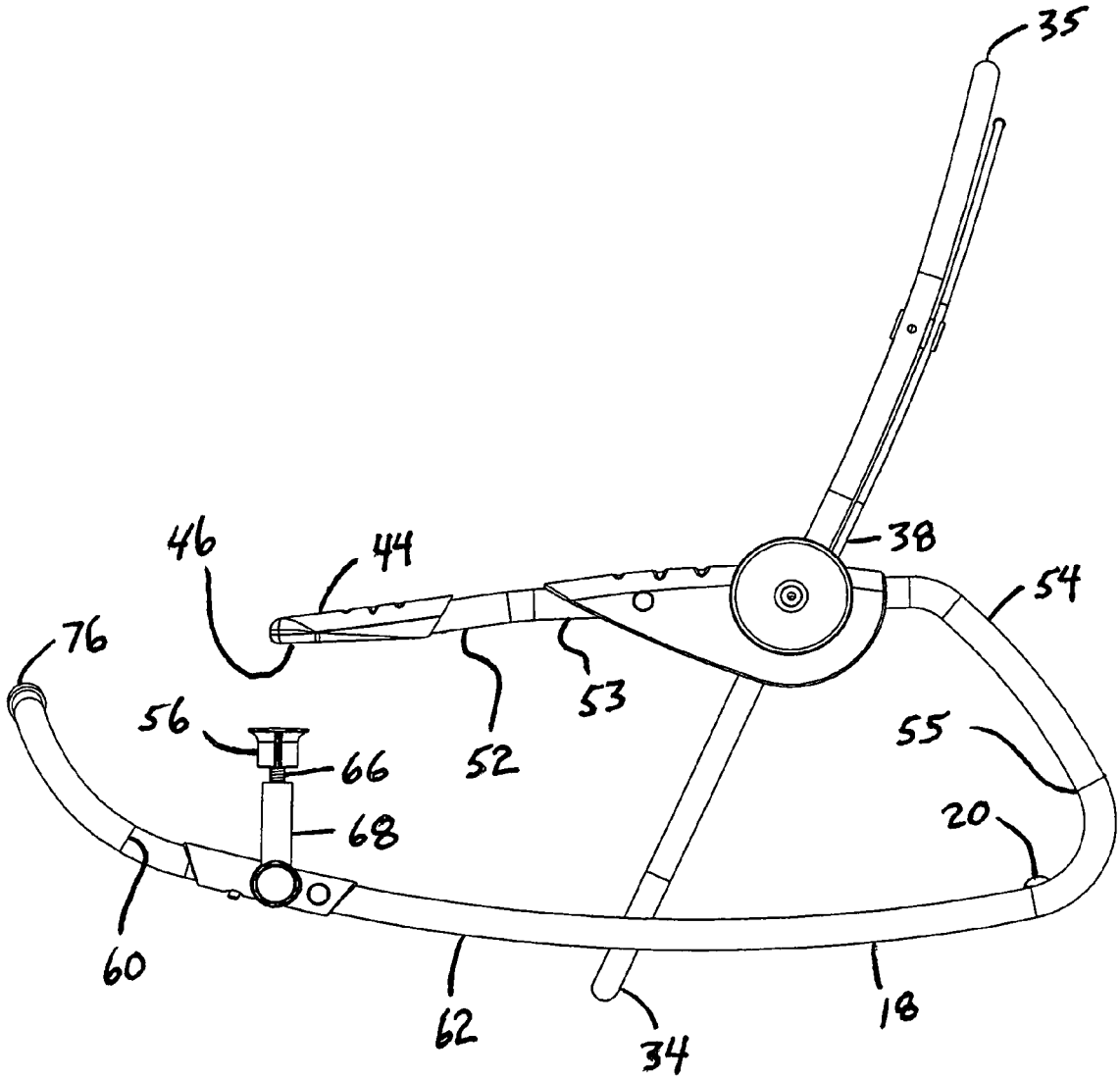
FIG. 2 is a left side view of the frame of the child seat of FIG. 1.
Figure 3:
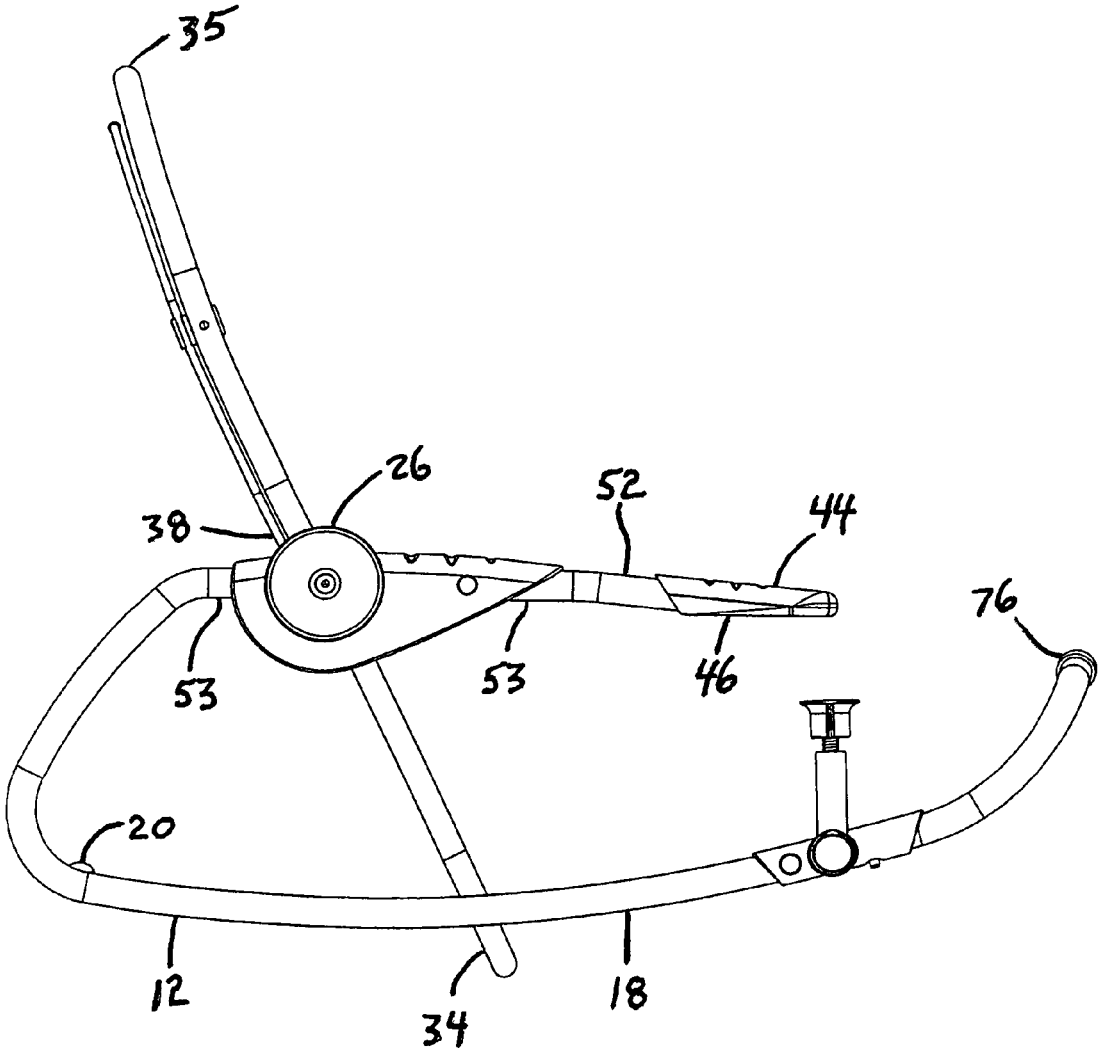
FIG. 3 is a right side view of the frame of the child seat of FIG. 1.
Figure 4:
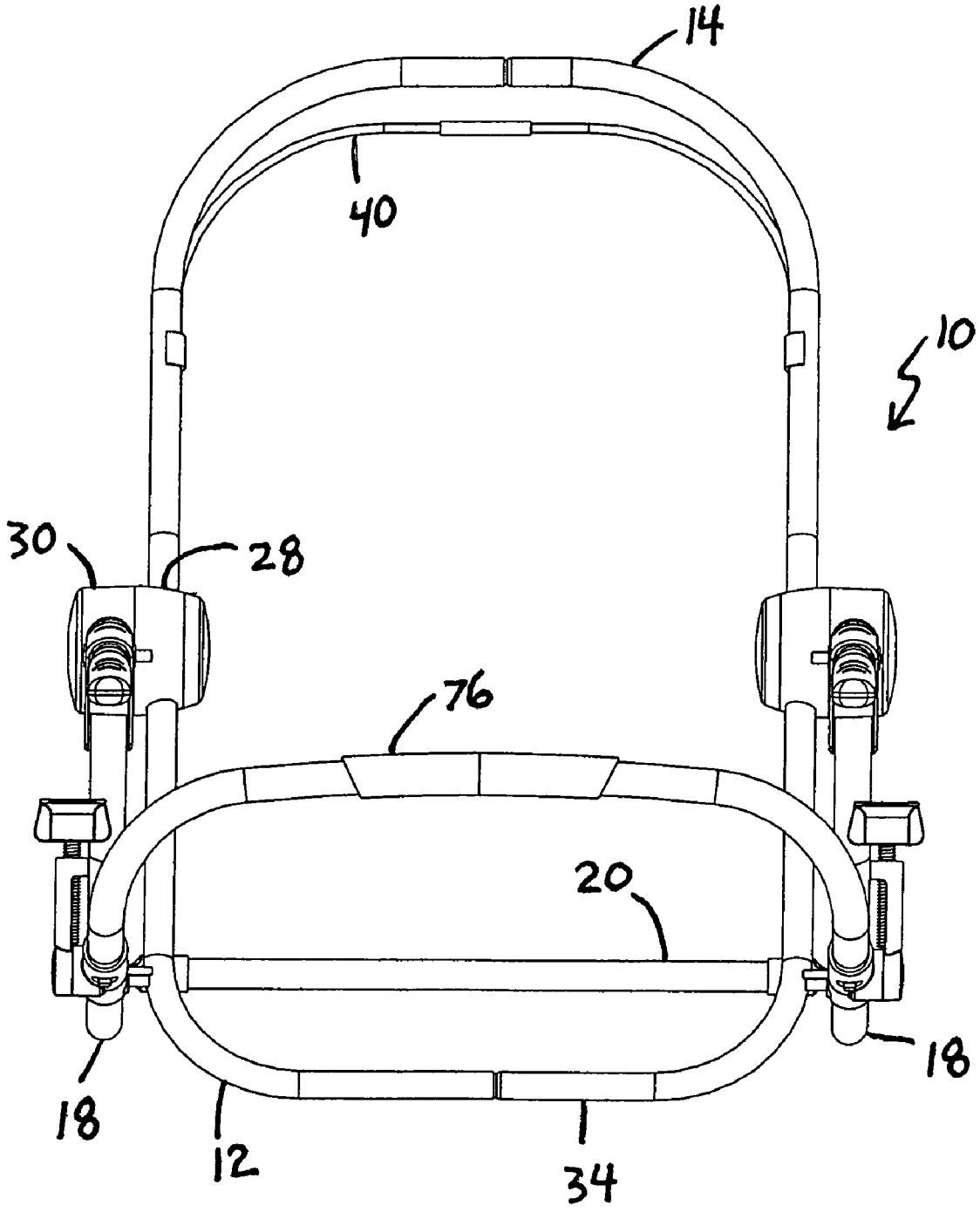
FIG. 4 is a front view of the frame of the child seat of FIG. 1.
Figure 5:
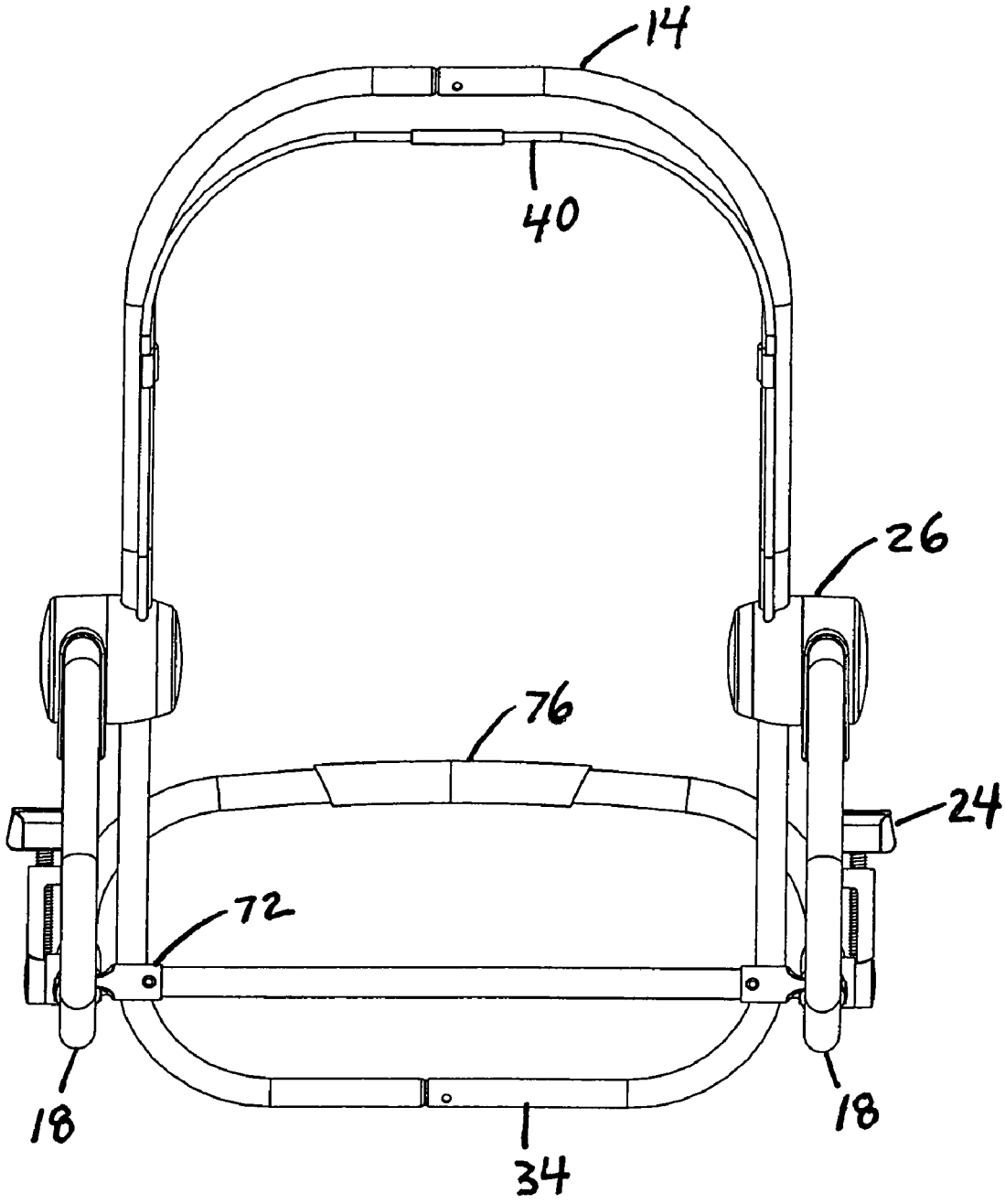
FIG. 5 is a rear view of the frame of the child seat of FIG. 1.

From FIGS. 2 and 3, it can be noted that the seat frame portion 14 is prevented from being swingable to and beyond 360 degrees by the rear brace 20. When the lower end section 34 is swung in the counter-clockwise direction from the perspective of FIG. 2, the lower end section 34 makes contact with the rear brace 20, which prevents a further swing in such direction. When the upper end section 35 is swung in the clockwise direction, the upper end section 35 makes contact with the rear brace 20, which prevents a further swinging in such direction. In other words, the distance between an axis running centrally through the hubs 26 and lower end section 34 is greater than the distance between such hub axis and brace 20. Similarly, the distance between an axis running centrally through the hubs 26 and the upper end section 35 is greater than the distance between such hub axis and brace 20. Further, inner structure found in hub portions 28, 30 can stop over-rotation, such as stems 140, against which ends 128, 130 may make contact to stop over-rotation.

As best shown in FIGS. 1, 2 and 3, each of the arm frame portions 16 includes a proximal end section 52 on which is mounted a relatively hard resilient grip 44. Arm grip 44 can be formed of a resilient plastic or elastomeric material. Such a resilient feature permits compression and a greater locking force to be applied by the lock 24. Arm grip 44 includes an underside 46 having a roughened surface to provide friction relative to a surface such as a top surface of the table T. Such a roughened surface can be a plurality of ridges, where, for examples, the ridges run traverse to the length of the arm frame portion 16. Grip 44 and its underside 46 can be relatively elongate.

Figure 8:
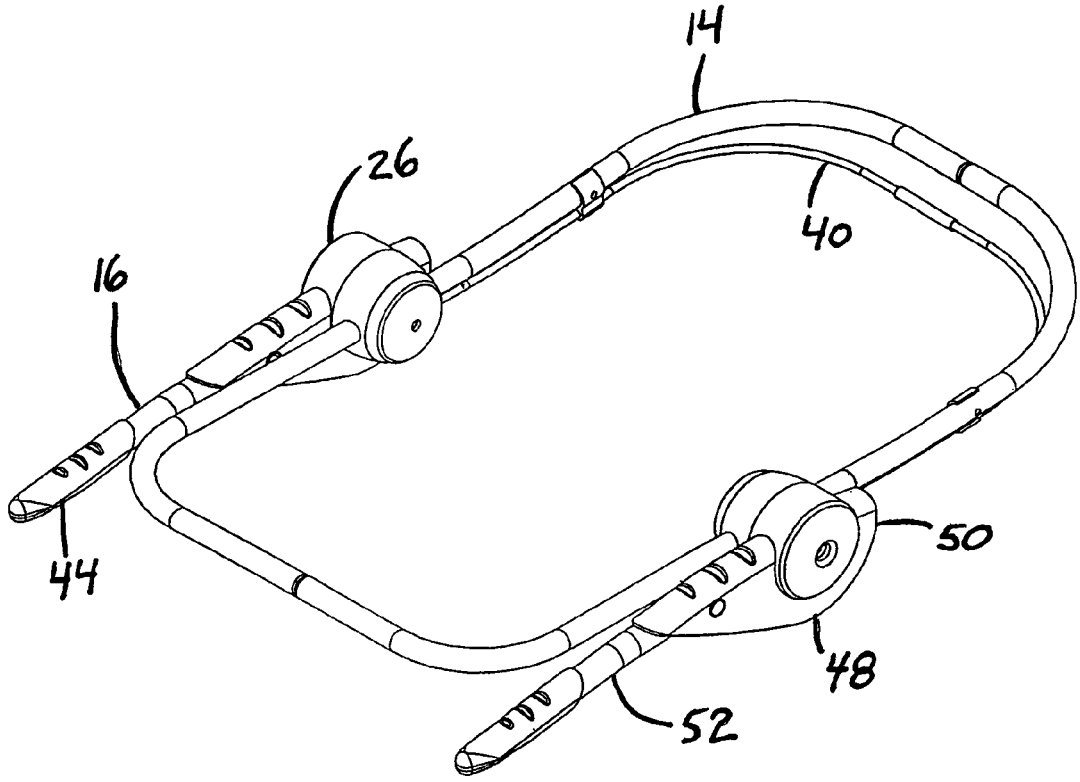
FIG. 8 is a perspective view of the seat frame portion and sections of the arm frame portions in a planar orientation disengaged from a remaining portion of the frame of the child seat of FIG. 1.

Each of the arm frame portions 16 further includes a brace 48 that extends to either side of the hub 26 for engaging arm frame sections on either side of hub 26. Brace 48 can further serve as a mount for mounting the outer hub portion 30. Arm frame sections of arm frame portion 16 can extend wholly through shell 104 of outer hub portion 30 or can be engaged with the shell 104 of outer hub portion 30 via a male/female connection or pin connection As shown in FIGS. 8 and 11, an arm frame section can be removably engagable with a rear portion 50 of brace 48. Specifically, as shown in FIG. 11, the arm frame portion 16 includes male/female connections 31 such that sections of the arm frame portion 16 can be removed from one another. After removal of arm sections from each other as shown in FIGS. 8 and 11, seat frame portion 14 can be rotated such that a plane in which the seat frame portion 14 lies is generally co-planar with a plane in which front arm sections 52, 53 lie (though sections 52, 53 are disposed at a slightly acute angle), where front arm sections 52, 53 are defined as those arm sections extending forwardly of, or engaged with, hub 26 and where rear arm sections 54 are defined as those arm sections extending rearwardly of the hub 26, as shown in FIG. 1. Such a rotation provides a generally flat form for storage of the child seat 10. In such a flat form, rear arm section 54 can be removably engaged with leg frame portion 18 at location 55, shown in FIG. 2, thereby permitting the leg portion 18 to have a generally flat form when locks 24 are rotated to be generally in line with an adjacent leg frame section. In such a flat form, rear brace 20 and front brace 22 remain engaged between leg frame portions 18.

Figure 6:
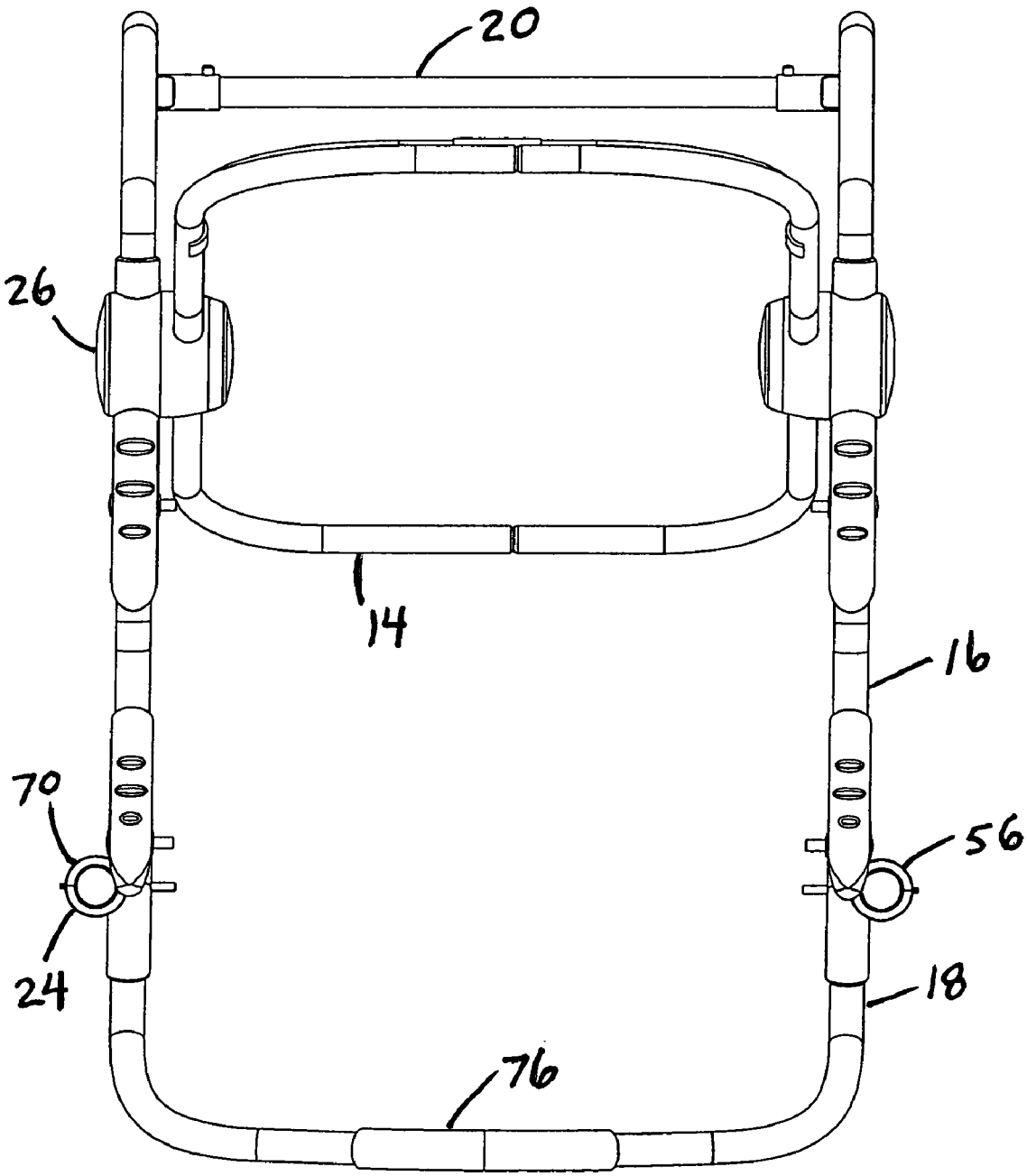
FIG. 6 is a top view of the frame of the child seat of FIG. 1.

As shown in FIG. 6, it can be appreciated that the front arm section 52 terminates at generally the location where the lock 24 is engaged to arm frame portion 18, such that, when lock 24 is in an extended, generally upright, and locked position where lock 24 extends at generally a right angle to front arm sections 52, 53 (which are disposed slightly angularly relative to each other), a lock grip 56 of lock 24 confronts the arm grip 44 of arm frame portion 16. The lock grip 56 is slightly outside of its respective arm grip 44 when viewed from the perspective of FIG. 6. The pivot enabling structure of a base 58 of lock 24, shown in FIG. 7, provides such an outside offset.

As described with reference to FIG. 3, it should be noted that front arm section 52 is disposed at an angle relative to a main arm section or sections 53 that runs or run through hub 26. More specifically, front arm section 52 includes a central longitudinal axis that is disposed at less than an 180 degree angle with a central longitudinal axis of main arm section or sections 53. Further, the underside 46 of arm grip 44 generally lies in a plane that is generally parallel to the central longitudinal axis of arm main section or sections 53 and that is oblique, specifically acute, relative to the central longitudinal axis of front arm section 52. Hence, when set upon a table surface top, front arm section 52 forms an acute angle with the table surface top, with the underside 46 of arm grip 44 laying flush with the table surface top. When lock 24 is applied against the underside of the table T, front arm section 52 is drawn down toward the table top but remains at a slight acute angle even when the lock 24 has been fully locked up against the underside of the table T.

Figure 7:
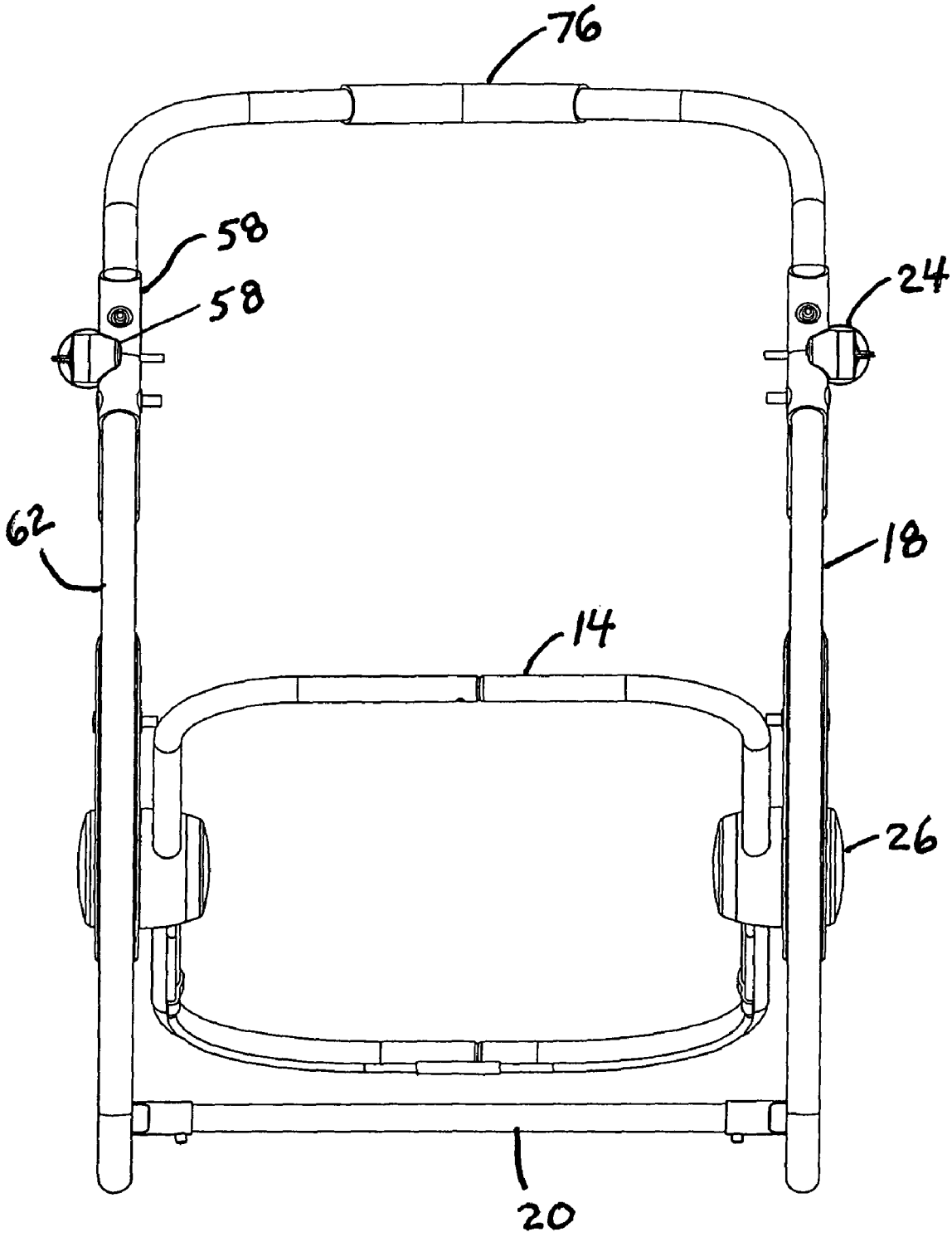
FIG. 7 is a bottom view of the frame of the child seat of FIG. 1.

As indicated in FIG. 6, and as indicated in FIG. 7 by the leg frame portions 18 blocking out the arm frame portions 16, arm frame portion 16 lies in a plane with the leg frame portion 18 to which it is immediately engaged. Each of such arm-leg planes is generally parallel to the other of the arm-leg plane.

Leg frame portion 18 runs generally from location 55, where frame 12 begins a transition to the arm frame portion 16, to location 60, as shown in FIG. 2, where frame 12 begins a transition into front brace or leg extension 22. Leg frame portion 18 includes a curved or rocker section 62, which preferably is one-piece with no seams or connections to other tubes, from about the location of the rear brace 20 to about the location of the lock 24. Such a seamless and one-piece tube or section 62 provides a smooth rocking motion when the child seat 10 is in use as a rocker. Otherwise, leg frame portion 18 includes leg tube sections engaged with male/female connections, as indicated by reference numeral 31 in FIG. 13.

Figure 10A:
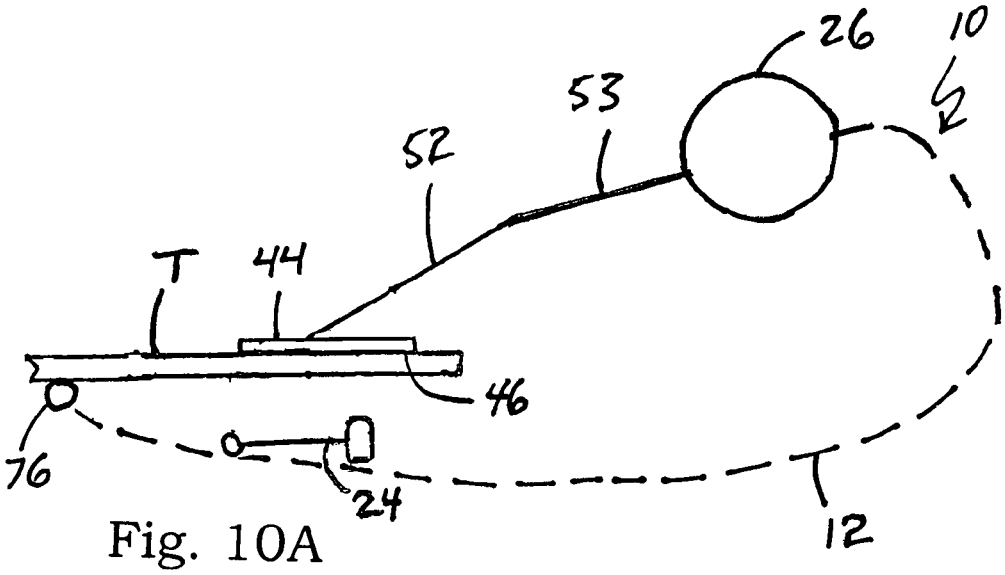
FIG. 10A shows the child seat of FIG. 1 in a diagrammatic exaggerated view prior to the lock being employed.

Lock 24 is engaged at a front location of curved section 62 via base 58. Lock 24 is pivotable relative to base 58 by the operation of a biased button 64 having an internal biased key mechanism. Pressing button 64 unlocks lock 24 from an upright operating and locked position, as shown in FIGS. 1-7, to an unlocked position, such as where lock 24 extends along the side of leg frame portion 18 either in a forward or rearward direction such as shown diagrammatically in FIG. 10A. When lock 24 is drawn up from such a position, lock 24 automatically snaps into a locked position, and such a locked position is where lock 24 extends at generally a right angle to the main arm section 53. Lock 24 is extendable in length via the grip 56 being rigidly fixed to a threaded shaft 66 turning into and out of a main tube 68 (or tubular portion of main body 68) of the lock 24. Grip 56 has wings 156 for a better grip for the finger while turning the grip 56 and shaft 66 relative to the main tube 68. Lock 24 is therefore adjustable for tables of different thicknesses.

Lock grip 56, unlike arm grip 44, is preferably not formed of a resilient material or of a material that provides substantial friction. Instead, lock grip 56 is relatively smooth to provide for a slipping into position underneath table T and to minimize friction with the underside of table T. Lock grip 56 can be formed of a plastic material. The relative smoothness to the upper annular portion 70 of lock grip 56, as shown in FIG. 6, maximizes an easy locking and unlocking operation as the upper annular portion 70 comes into and out of engagement with the underside of an object such as a table T. Further, the annular portion 70, as opposed to a wholly disk like flat portion, minimizes the surface area of the contact portion of the lock 24 to minimize friction with the underside of the table T as the portion 70 comes into and out of contact with the underside of the table T.

Rear brace 20 is fixed to and between the leg frame portions 18. Rear brace 20 provides rigidity to the frame 12 and further shields a child in the child seat 10, especially when the child seat 10 is being used as a booster seat and extends into the air where the back of a child may otherwise be exposed. Rear brace 20 is engaged at either end in tubular seats 72 fixed to the leg frame portions 18.

Each of the front brace portions or leg extensions 74 extends, from its respective leg frame portion 18, upwardly and outwardly and then laterally where each of the front brace portions 74 meets with and joins to the other of the front brace portions 74. Together, the front brace portions 74 make up the front brace 22.

Front brace 22 includes a relatively hard and resilient leg grip 76. Leg grip 76, like arm grip 44, can be formed of a resilient plastic or elastomeric material. Such a resilient feature permits compression and a greater locking force to be applied by the lock 24. Leg grip 76 can be formed of a tubular piece or of a pair of tubular pieces, one engaged with each of the front brace portions 74. As such, leg grip 76 is somewhat elongate.

The frame sections that make up seat frame portion 14, arm frame portions 16, leg frame portions 18, rear brace 20, front brace 22, and locks 24 are preferably tubular. Such tubular frame sections can be formed of a metal, a plastic, or of a composite material.

One three point arrangement is provided by one set of grips, i.e., one arm grip 44, its confronting lock grip 56, and the leg grip 76. Another three point arrangement is provided by the other set of grips, i.e., the other arm grip 44, its confronting lock grip 56, and the leg grip 76. Each of the three point arrangement shares a point or a location, the leg grip 76.

When the three point arrangements are combined, a five point arrangement is provided, where portions 74 are counted as one point. It should be noted that "point" means location and does not mean a strict mathematical point that has no dimension.

It should be noted that child seat 10 may engage a table T or other object by employing, in a two point arrangement, only one arm grip 44 and the leg grip 76. More preferred is a three point arrangement that includes one arm grip 44, the other arm grip 44, and the leg grip 76. Still more preferred is a three point arrangement that includes one arm grip 44, the lock 24 confronting such arm grip 44, and the leg grip 76. Even more preferred is the five point arrangement that includes both arm grips 44, both locks 24, and the leg grip 76.

Figure 9A:
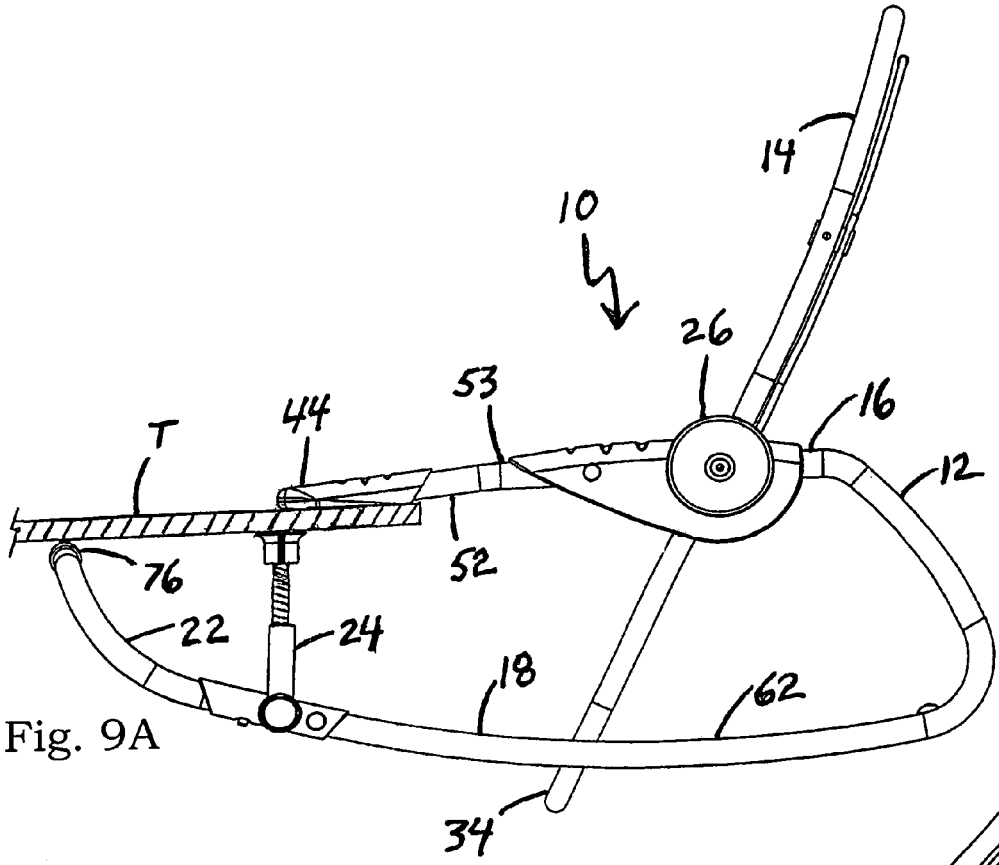
FIG. 9A shows the child seat of FIG. 1 being used as a booster seat, engaged to the edge of a table and extending into the air.
Figure 9B:
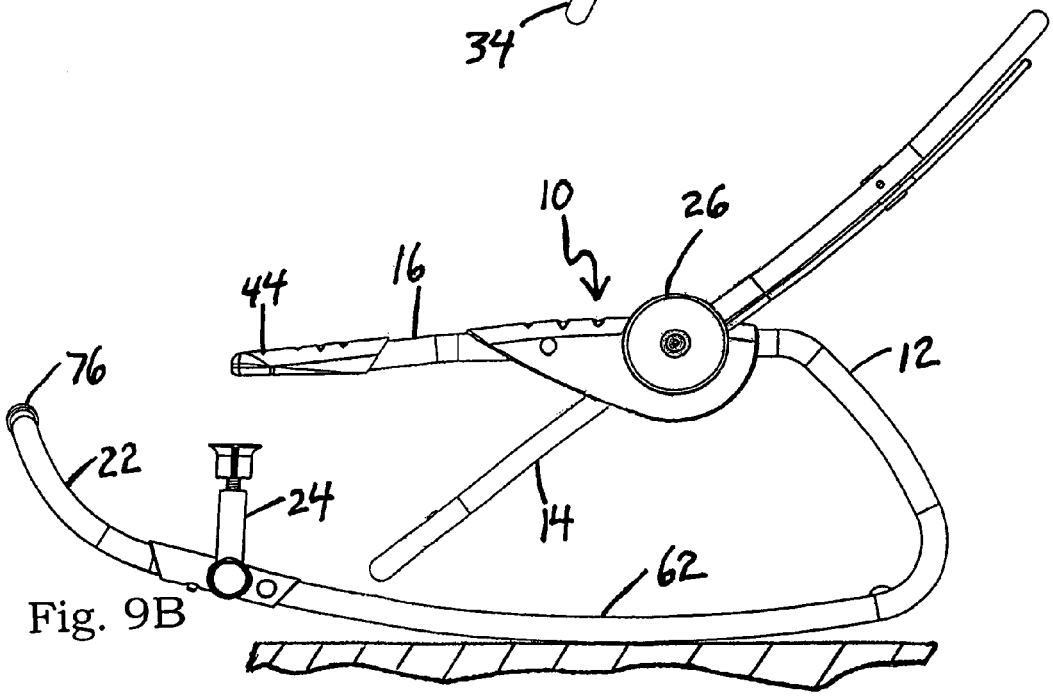
FIG. 9B shows the child seat of FIG. 1 being used as a rocker.
Figure 10B:
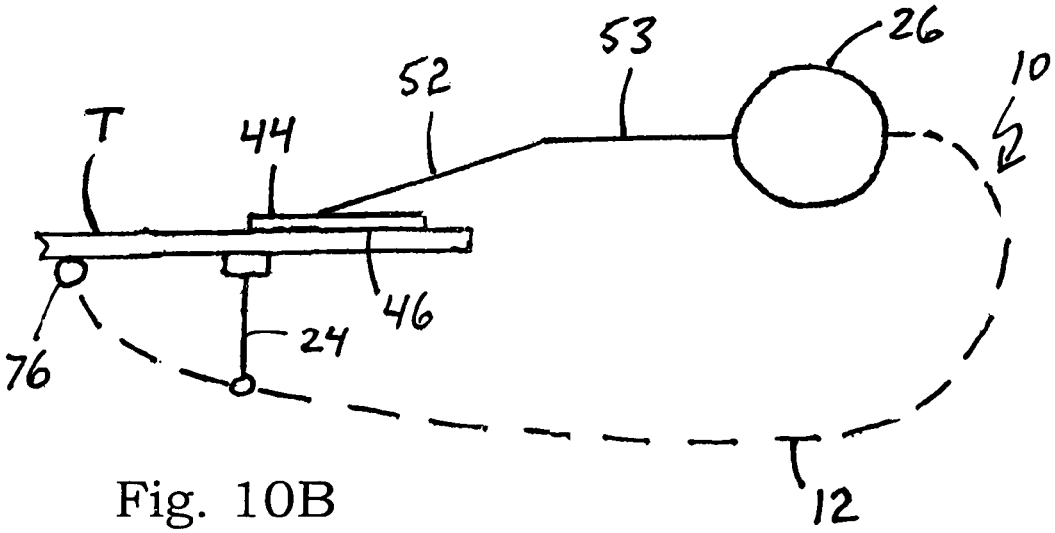
FIG. 10B shows the child seat of FIG. 1 in a diagrammatic exaggerated view after the lock is employed.

In operation, as a booster seat, as shown in FIG. 9A, child seat 10, preferably without a child in the child seat, is lifted to the edge of an object such as a table T. Then, with the locks 24 pivoted to an out-of-the-way position such as generally parallel to leg frame portion 18, the arm grips 44 are rested on the upper surface of the table T. At such point, the user may let go of (take his or her hands off) the child seat 10, whereupon the child seat 10 may drop down slightly, which in turn may bring the leg grip 76 up against the lower surface of the table T, which still in turn keeps the child seat 10 from dropping further, resulting in the immediately prelocked position shown in FIG. 10A). Then (or prior to the child seat 10 being even preliminarily engaged to the table T) the caregiver can turn (rotate) the winged lock grips 56 on shaft 66 to draw the winged lock grips 56 to or away from the arm grips 44 and to or away from the underside of the table T such that the caregiver adjusts the length of the locks 24 to (or slightly less than) the thickness of the table T. Then the caregiver swings each of the locks 24 (as a whole) to the upright, operating, snapped and locked position, thereby locking the child seat 10 to the table T such that locations 44 and 76 bite against opposing surfaces of table T. During the locking process, the arm frame sections 52 are drawn down to lie against and generally parallel to the surface of the table T (or at a slight acute angle relative to the surface of the table T with main arm section 53 being generally parallel to the surface of the table T, as shown in FIG. 10B, the preferred orientation). During the locking process, resilient frame 12 or some portion thereof is slightly expanded or placed under pressure. Expansion (or such pressure) may occur by arm frame portion 16 (namely main arm section 53) and leg frame portion 18 (namely curved leg section 62) being slightly drawn apart, or by curved leg section 62 becoming slightly more bowed, or by main arm section 53 and rear arm section 54 as a whole becoming slightly more bowed, or by some combination or resilient portion of the above. Further, after locks 24 are swung upwardly and locked, winged lock grips 56 can be further rotated to further tighten the locks 24 against the underside of table T, to further tighten the bite between locations 46 and 76, and to further compress or place stress into the frame 12. Then the child can be placed in the child seat 10. With the weight of the child in the child seat 10, front arm sections 52 remain generally parallel to the surface of the table T (or remain at a slightly acute angle relative to the surface of the table T with main arm section 53 being generally parallel to the surface of the table T, as shown in FIG. 10B, the preferred orientation). Preferably, the bite into table T is so strong that the weight of the child has a minimal effect upon the angular relationships of the arm frame section 16 and leg frame section 18 relative to the table T. Then, or prior to the child being placed in the child seat 10, the seat frame portion 14 can be swingably adjusted via handle 40 such that the child can sit in a relatively upright position next to the table T. During such a swinging adjustment, the lower end section 34 of the seat frame portion 13 can swing beneath and beyond the rocker tubing or curved section 62. If the child goes to sleep while the child seat 10 is engaged to the table T, the seat frame portion 14 can be relatively reclined.

One stop for an excessively reclined position can include the edge of the table T, depending upon how far the arm frame front arm sections 52 reach across the table surface; the total length of the front arm sections 52, 53 from hub 26 is greater than the distance of lower end section 34 from hub 26. Another stop for an excessively reclined position is the rear brace 20. Other stops for an excessively reclined position may be found in the internal structure of hub 26.

One stop for an excessively forwardly swung position is the edge of the table T; the total length of the front arm sections 52, 53 from hub 26 is less than the distance from upper end section 35 to hub 26. Another stop of an excessively forwardly swung position is the rear brace 20. Other stops for an excessively forwardly swung position may be found in the internal structure of hub 26.

To remove the child seat 10 from the table T, the child is removed from the child seat 10. Then the buttons 64 are pushed to unlock the locks 24, which in turn are swung away from the underside of the table T, whereupon the rear portion of the child seat 10 automatically slightly raises, due to the predefined geometry of the frame 12 and the relief or release of the stress applied by the locks 24. Then the rear portion of the child seat 10 is raised up slightly more and the child seat 10 is removed from the edge of the table T.

In operation as a rocker, as shown in FIG. 9B, the locks 24 may or may not be moved to an out-of-the-way position such as to a position generally parallel to the leg frame section 18. The seat frame portion 14 can then be adjusted to lie at the selected angle relative to a remaining portion of the frame 12, with lower end section 34 being above curved sections 62. Then a child can be placed in the child seat 10 and rocked via the curved sections 62.

The present invention includes a child seat 10 that includes a frame 12 which in turn includes: a) a seat frame portion 12; b) at least one leg frame portion 18 for supporting the child seat 10 relative to a surface of an object T, with the leg frame portion 18 including a curved frame section 62 on which the frame 12 can rock when the child seat 10 is in use as a rocker; and c) a three point frame arrangement adaptable for engaging an object having opposing surfaces such that the child seat hangs off the object T via the three point frame arrangement with the curved frame section 62 of the leg frame portion 18 extending into the air when the child seat 10 is in use as a booster. More preferred is a five point arrangement where the frame includes a pair of lock points 56 confronting, through the object T, a pair of arm points 44, and where a lateral brace 22 abuts the underside of the object T at a fifth point 76, where the fifth point 76 is forwardly and medially of the pair of lock points 56 (and forwardly and medially of the pair of arm points 44), and where the pair of lock points 56 and pair of arm points 44 are between the fifth point 76 and the hubs 26.

It should be noted that, if desired, the leg extensions 74 can run forwardly and upwardly and in the same plane as its respective arm frame portion 16 and its respective leg frame portion 18 such that there is no shared point 76 and such that each of the leg extensions terminates in its own point and includes its own resilient leg grip. In such an embodiment, a six point arrangement is constructed. In such an embodiment a front brace may or may not be included. If a front brace is included, such front brace can be identical to rear brace 20 except such front brace can have a forward location, such as immediately forwardly of locks 24 and running between the leg frame portions 18. Such is not preferred however because the dual advantages of a brace and grip are not provided.

The present invention includes a child seat 10 that includes a frame 12 that includes a seat frame portion 14, a pair of generally parallel arm frame portions 16, and a pair of generally parallel leg frame portions 18, where the seat frame portion 14 is swingably engaged between the generally parallel arm frame portions, where front ends of the arm frame portions 16 confront respective locks 24 extending from the leg frame portions 18 to clamp an object therebetween, and where each of the leg frame portions 18 includes extensions 74 running forwardly, inwardly and upwardly of where the locks 24 engage the leg portions 18, and with the leg extensions 74 joining each other at an altitude of the grips 56 of the locks 24 when the locks 24 are clamped to the object.

The present invention includes a child seat 10 that includes the frame 12 that includes a seat frame portion 14, an arm frame portion 16, a leg frame portion 18, a lock frame portion 24, and a three-point arrangement having points or locations 44, 56 and 76, where, when lock 24 is unengaged to an object such as table T, the arm frame portion 16 includes an arm section 52 extending from location 46 and being disposed at an acute and upwardly angle relative to location 46 and relative to a top surface of table T, where, when lock 24 is engaged to an object such as table T, the arm section 52 is disposed at an acute and upwardly angle relative to location 46 and relative to the top surface of table T, where, when lock 24 is unengaged, a main arm section 53 is disposed at an acute angle relative to location 46 and the top surface of table T, and where, when lock 24 is engaged to table T, the main arm section 53 is disposed generally parallel to location 46 and the top surface of table T.

It should be noted that in some prior art child seats, the lock was the weight of the child. In other words, the prior art child seats that had no locks relied upon the weight of the child to keep the prior art structure biting into the table. With the present child seat 10, the swinging of lock or plunger 24 into the locked position forces stress into or an expansion of the resilient frame 12 and makes points 46 and 76 firmly bite into or clamp against table T.

It should be noted that seat frame portion 12 need not lie generally in one plane. For example, the lower U-shaped half section of seat frame portion 12 can be disposed at a right angle, acute angle, or obtuse angle relative to the upper U-shaped half section of seat frame portion 12. In other words, it should be noted that the lower (or upper) U-shaped half section of seat frame portion 12 can be engaged at other locations on inner hub portion 28 to provide for the right, acute or obtuse angles of the U-shaped half sections relative to each other. Or, if desired, each of the lower and upper U-shaped half sections can be engaged with an individual hub portion such that the angle of the U-shaped half sections relative to each other can be incrementally adjusted.

As shown in FIGS. 11 and 12, hub 26 includes the inner hub portion 28 and the outer or opposing hub portions 30. Hub portion 28 is engaged between outer hub portions 30 with a pin connector 100. Outer hub portions 30 ride on pin connector 100 via a cylindrical stem 102. An outer shell 104 of outer hub 30 rotationally engages an outer shell 106 of inner hub 28 via a shiplap connection 108 which in turn engages outer shell 144 via shiplap connection 146. Inner hub 28 includes a coil spring 110 for biasing lock 36 and its end portion 38 fully into inner hub portion 28 such that inner hub portion 28 is normally biased to lock with outer hub portions 30.

Outer hub portion 30 includes a set of three mounts or bosses 112 for mating with female receptors 114 of a disk 116 that closes off the open end of shell 104. Pin connectors such as screws engage the female receptors 114 and bosses 112 to engage disk 116 to shell 104. Outer shell 104 has a pair of diametrically opposed front and rear openings 118, 120 for receiving portions of the arm frame portions 16. Pin 100 extends through a lateral opening 122 in arm frame portion 16.

Seat frame portion 14 includes an upper side section 124 and a lower side section 126. Upper side section 124 includes a perforated bar or male end 128 and lower side section 126 includes a perforated bar or male end 130 that confront each other side to side, as shown in FIG. 12, where a pair of smaller openings 132 of one end 128 confront a pair of smaller openings 132 of the other end 130 such that the ends 128, 130 can be engaged to each other via pin connectors extending through the smaller openings 132. Each of ends 128, 130 includes a single larger opening 134 that is coaxial with the other single larger opening 134. Openings 134 rotatably engage stem 102 of disk 116. Upper side section 124 extends through an opening 136 of shell 106 and lower side section 126 extends through a diametrically opposed opening 138 of shell 106.

Disk 116 includes a pair of stems 140, on either side of stem 102, that space and mount a notched plate 142 that in turn mounts an outer shell 144 of outer hub portion 30 such that inner hub portion 28 rotates or spins between the shells 104 and 144. A second shiplap connection 146 is formed where shell 106 rides on shell 144. Notched plate 142 has pin connector openings that line up with stems 140. Notched plate 142 includes an opening for main pin connector 100. Notched plate 142 further includes pin connector openings for engaging notched plate with shell 144. Notched plate 142 further includes a set of three notches 148.

Lock 36 includes the distal end portion 38 which in turn includes the terminal end 150 that extends at a right angle to distal end portion 38. Terminal end 150 engages one end of coil spring 110 and further engages one of the notches 148. The other end of coil spring 110 engages stem 102, as shown in FIG. 12. When handle 40 is squeezed to draw terminal end 150 out of one of the notches 148, hub portion 28 is free to rotate relative to shells 104 and 144 such that terminal end 150 may be brought into engagement with another of the notches 148. An engagement between terminal end 150 and the upper notch 148 locks the seat frame portion 14 into a relatively upright position. An engagement between terminal end 150 and the lower notch 148 locks the seat frame portion 14 into a relatively reclined position. An engagement between terminal end 150 and the medial notch 148 locks the seat frame portion 14 into a position between the relatively upright position and the relatively reclined position.

Figure 13:
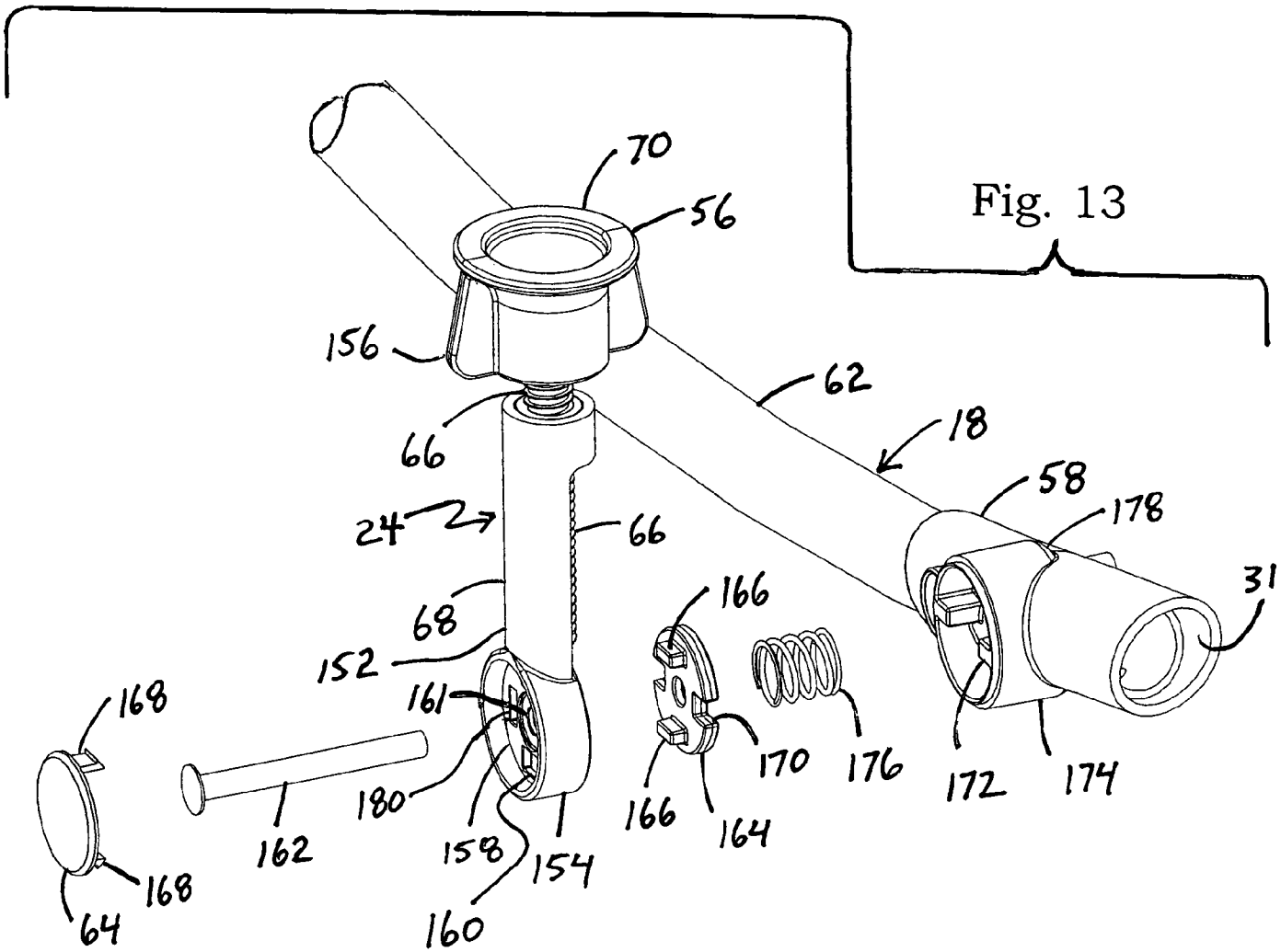
FIG. 13 shows an exploded perspective view of the lock or plunger of the child seat of FIG. 1.

As shown in FIG. 13, lock 24 includes a main body 152 having a cylindrical end 154 on which is mounted the tube 68 that threadingly engages threaded shaft 66. Grip 56 is fixed to an end of shaft 66 and includes wings 156 to assist in rotating grip 56 and therefore rotating shaft 66 to draw shaft 66 into and out of the main body 152. Cylindrical end 154 includes an inner disk 158 having a pair of upper and lower rectangular through openings 160. Inner disk 158 further includes a central opening 161 for receiving a pin connector 162 that engages lock 24 to leg frame portion 18. Lock 24 further includes a key 164 that rides on pin connector 162 and that includes upper and lower tabs or interlocks 166 that can engage rectangular openings 160 of the cylindrical end 154. Upper and lower tabs or interlocks 166 are pushed out of the rectangular openings 160 via tabs or pushers 168 diametrically extending inwardly from an inner perimetrical portion of button 64. Key 164 includes side slots 170 that ride on tracks 172 formed in a cylindrical portion 174 of base 58. A coil spring 176 is pinched between key 164 and an end wall 178 of cylindrical portion 174 and rides on main pin connector 162. Coil spring 176 normally biases key 164 in the direction of disk 158 so as to normally bias interlocks 166 into rectangular openings 160 and therefore lock 24 into an upright position. A second pair of rectangular openings 180, formed side to side in disk 158, receive interlocks 166 when lock 24 is turned to an out-of-the-way position, such as when main body 68 lies generally parallel to curved section 62 of leg frame portion 18. Accordingly, to unlock lock 24 relative to base 58, button 64 is pushed, which pushes pushers 168 into interlocks 166 and hence disengages key 164 from inner disk 158, which permits main body 68 to pivot relative to base 58. After some rotation of main body 68, button 64 can be released while continuing a pivoting motion to main body 68, whereupon interlocks 166 can snap into one of the pair of rectangular openings 160, 180 as soon as such openings 160 and 180 are rotated into position, whereupon main body 68 is locked to an upright position or to a position generally parallel to curved section 62.

It should be noted that the present invention further includes a child seat comprising a frame which in turn includes: a) a seat frame portion; b) a three point frame arrangement adaptable for engaging an object having opposing surfaces such that the child seat hangs off the object via the three point frame arrangement with the child seat extending into the air when the child seat is in use as a booster; c) a lock frame portion to pivotally lock against a surface of the object to lock the child seat to the object; d) with the seat frame portion being angularly adjustable relative a remaining portion of the frame; and e) with the seat frame portion being angularly adjustable relative to a remaining portion of the frame while the three point frame arrangement is engaged to the object and while the child seat hangs off the object and extends into the air.

The child rocker and booster seat 10 includes a frame 12 which in turn includes a seat frame 14 and at least one leg frame portion 18 for supporting the seat frame 14 of the child rocker and booster seat 10 relative to a surface (shown in FIG. 9B) such that the leg frame portion 18 makes contact with the surface when the child rocker and booster seat 10 is on the surface and such that the leg frame portion 18 and the seat frame 14 are spaced apart from each other.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A child rocker and booster seat comprising a frame which in turn comprises:

a) a seat frame;

b) at least one leg frame portion for supporting the seat frame of the child rocker and booster seat relative to a surface such that said leg frame portion makes contact with said surface when the child rocker and booster seat is on said surface and such that said leg frame portion and said seat frame are spaced apart from each other, with the leg frame portion comprising a curved frame rocker on which the frame can gently rock when the child rocker and booster seat is on said surface;

c) a frame arrangement for engaging a table having opposing surfaces such that the child rocker and booster seat hangs off the table via the frame arrangement with the curved frame rocker of the leg frame portion extending into the air when the child rocker and booster seat is engaging said table, wherein the frame arrangement comprises:

i) an arm frame portion; and ii) a confronting frame portion confronting the arm frame portion such that the arm frame portion and confronting frame portion bite the table therebetween;

d) wherein the arm frame portion has an end making contact with an upper side of a table top of the table, wherein the confronting frame portion has an end making contact with a lower side of the table top of the table, and wherein the end of the arm frame portion confronts the end of the confronting frame portion; and e) wherein said seat frame includes a lowermost end, and with said lowermost end being above said curved frame rocker when said child rocker and booster seat is in a child rocker orientation.

2. The child rocker and booster seat according to claim 1, and further comprising another leg frame portion such that the child rocker and booster seat includes a pair of leg frame portions.

3. The child rocker and booster seat according to claim 2, and further comprising front and rear braces between the leg frame portions.

4. The child rocker and booster seat according to claim 1, and further comprising another arm frame portion such that the child rocker and booster seat includes a pair of arm frame portions.

5. The child rocker and booster seat according to claim 1, wherein said arm frame portion defines a plane with said leg frame portion.

6. The child rocker and booster seat according to claim 1 wherein the seat frame is breakable down into sections.

7. The child rocker and booster seat according to claim 1, wherein the confronting frame portion is extendable in length such that the confronting frame portion accommodates tables of different thicknesses.

8. The child rocker and booster seat according to claim 1, wherein the confronting frame portion comprises a threaded shaft and a tube, with the threaded shaft turning into and out of the tube such that the confronting frame portion accommodates tables of different thicknesses.

9. The child rocker and booster seat according to claim 1, wherein the seat frame the leg frame portion, the arm frame portion, and confronting frame portion are tubular.

10. A child rocker and booster seat comprising a frame which in turn comprises:

a) a seat frame;

b) a pair of leg frame portions for supporting the seat frame of the child rocker and booster seat relative to a surface and front and rear braces between the leg frame portions such that said leg frame portion makes contact with said surface when the child rocker and booster seat is on said surface and such that said leg frame portion and said seat frame are spaced apart from each other, with each of the leg frame portions comprising a curved frame rocker on which the frame can gently rock when the child rocker and booster seat is on said surface;

c) a frame arrangement for engaging a table having opposing surfaces such that the child rocker and booster seat hangs off the table via the frame arrangement with the curved frame rocker of the leg frame portion extending into the air when the child rocker and booster seat is engaging said table, wherein the frame arrangement comprises:

i) a pair of arm frame portions for engaging an upper surface of a table; and ii) a pair of extendable portions for engaging a lower surface of the table, with the arm frame portions and extendable portions biting the table therebetween, with said extendable portions being extendable in length to accommodate tables of different thicknesses; and d) wherein the seat frame angularly engages the arm frame portion, wherein the seat frame includes a lower end section, an upper end section, and a side section, wherein the side section is engaged to the arm frame portion at a location above the curved frame rocker, with said location being vertically aligned, from a side view, with a point on the curved frame rocker.

11. The child rocker and booster seat according to claim 10, wherein said leg frame portion includes leg tube sections engaged with a male/female connection, with one of said leg tube sections being said curved frame rocker.

12. A child rocker and booster seat comprising a frame which in turn comprises:

a) a seat frame, with the seat frame being breakable down into sections, and with the seat frame being tubular;

b) a pair of leg frame portions for supporting the seat frame of the child rocker and booster seat relative to a surface and front and rear braces between the leg frame portions such that said leg frame portion makes contact with said surface when the child rocker and booster seat is on said surface and such that said leg frame portion and said seat frame are spaced apart from each other, with each of the leg frame portions comprising a curved frame rocker on which the frame can gently rock when the child rocker and booster seat is on said surface, and with each of the leg frame portions being tubular;

c) a frame arrangement for engaging a table having opposing surfaces such that the child rocker and booster seat hangs off the table via the frame arrangement with the curved frame rocker of the leg frame portion extending into the air when the child rocker and booster seat is engaging said table, wherein the frame arrangement comprises:

i) a pair of arm frame portions, wherein each of the arm frame portions is paired with a respective leg frame portion and defines a plane therewith such that a pair of arm-leg planes are defined, with the seat frame being engaged to the arm frame portions, and with each of the arm frame portions being tubular; and ii) a pair of confronting frame portions, with each of the confronting frame portions confronting one of the arm frame portions such that arm frame portions and confronting frame portions bite the table therebetween, with each of the confronting frame portions being extendable in length such that the confronting frame portions accommodate tables of different thicknesses, with each of the confronting frame portions comprising a threaded shaft and a tube, and with said threaded shaft turning into and out of said tube; and d) wherein the seat frame angularly engages the arm frame portion, wherein the seat frame includes a lower end section, an upper end section, and a side section, wherein the side section is engaged to the arm frame portion at a location above the curved frame rocker, with said location being vertically aligned, from a side view, with a point on the curved frame rocker.

13. The child rocker and booster seat according to claim 12, wherein said leg frame portion includes leg tube sections engaged with a male/female connection, with one of said leg tube sections being said curved frame rocker.

14. The child rocker and booster seat according to claim 1, wherein the seat frame angularly engages the arm frame portion, and wherein the seat frame is engaged to the arm frame portion at a location above the curved frame rocker.

15. The child rocker and booster seat according to claim 1, wherein the seat frame angularly engages the arm frame portion, and wherein the seat frame is engaged to the arm frame portion at a location above the curved frame rocker, with said location being vertically aligned, from a side view, with a point on the curved frame rocker.

16. The child rocker and booster seat according to claim 1, wherein the seat frame angularly engages the arm frame portion, and wherein the seat frame includes a lower end section, an upper end section, and a side section, wherein the side section is engaged to the arm frame portion at a location above the curved frame rocker.

17. The child rocker and booster seat according to claim 1, wherein the seat frame angularly engages the arm frame portion, wherein the seat frame includes a lower end section, an upper end section, and a side section, wherein the side section is engaged to the arm frame portion at a location above the curved frame rocker, with said location being vertically aligned, from a side view, with a point on the curved frame rocker.

18. The child rocker and booster seat according to claim 1, wherein the seat frame angularly engages the arm frame portion, and wherein the seat frame includes an end section disposed above the curved frame rocker.

19. The child rocker and booster seat according to claim 1, wherein the seat frame includes a lower end section, an upper end section, and a side section, wherein the side section is engaged to the arm frame portion at a location above the curved frame rocker, with said location being vertically aligned, from a side view, with a point on the curved frame rocker.

20. The child rocker and booster seat according to claim 1, wherein said leg frame portion includes leg tube sections engaged with a male/female connection, with one of said leg tube sections being said curved frame rocker.

* * * * *